US006188371B1

(12) United States Patent
Li et al.

(10) Patent No.: US 6,188,371 B1
(45) Date of Patent: Feb. 13, 2001

(54) LOW-PROFILE ADJUSTABLE-BAND ANTENNA

(75) Inventors: Kevin Li; Brian Louis Wixom, both of San Diego; Leon Chia-Liang Lin, Union City; Thomas Stanley Seay, Solana Beach, all of CA (US)

(73) Assignee: Quake Wireless, Inc., San Diego, CA (US)

( * ) Notice: Under 35 U.S.C. 154(b), the term of this patent shall be extended for 0 days.

(21) Appl. No.: 09/358,091

(22) Filed: Jul. 21, 1999

(51) Int. Cl.[7] ..... H01Q 11/12

(52) U.S. Cl. ..... 343/866; 343/741; 343/846; 343/847

(58) Field of Search ..... 343/866, 846, 343/847, 848, 741, 700 MS; H01Q 1/38

(56) References Cited

U.S. PATENT DOCUMENTS

| | | | | |
|---|---|---|---|---|
| 4,827,266 | * | 5/1989 | Sato et al. | 343/700 MS |
| 4,862,181 | | 8/1989 | Ponce De Leon et al. . | |
| 5,764,190 | * | 6/1998 | Murch et al. | 343/700 MS |
| 5,767,810 | * | 6/1998 | Hagirawa et al. | 343/700 MS |
| 5,880,697 | | 3/1999 | McCarrick et al. . | |
| 6,002,367 | * | 12/1999 | Engblom et al. | 343/846 |

OTHER PUBLICATIONS

Burberry, "VHF and UHF Antennas" Peter Peregnus, Ltd. UK, 1992, p. 161.

Johnson, "Antenna Engineering Handbook" 3rd. ed., Georgia Institute of Technology, 1993, pp. 27–21, 37–18/19.

* cited by examiner

*Primary Examiner*—Don Wong
*Assistant Examiner*—Hoang Nguyen
(74) *Attorney, Agent, or Firm*—Edward W. Callan

(57) ABSTRACT

A low-profile antenna includes a ground-plane element defining a ground plane and an elongated radiator element configured and disposed in relation to the ground plane to define a vertical loop when the ground plane is horizontally disposed. A substantial broad segment of the radiator element is parallel to the ground plane. One end of the radiator element is connected to the ground-plane element and another end of the radiator element having spaced-apart legs with feet is capacitively coupled to the ground-plane element by dielectric spacing elements that are disposed between the feet of the radiator element and the ground-plane element. A conductive-material layer contacts the feet between the feet and the dielectric spacing element. An exposed portion of the conductive-material layer that extends from beneath the feet of the radiator element includes removal tabs for enabling the capacitive coupling to be adjusted by removing at least some of the exposed tabs. The adjustable capacitive coupling and the dimensions and configuration of the radiator element are such as to enable the radiator element to resonate within an adjustable band of frequencies within a predetermined range of frequencies. A tuning circuit is coupled to the radiator element for selectively enabling the antenna to transmit signals at a first frequency within the adjustable frequency band or to receive signals at a second frequency within said band. The radiator element includes longitudinal folds distending from the sides of the substantial broad segment.

23 Claims, 2 Drawing Sheets

LOW-PROFILE ADJUSTABLE-BAND ANTENNA

BACKGROUND OF THE INVENTION

The present invention generally pertains to antennas and is particularly directed to low-profile antennas.

Low-profile antennas are used on aircraft and various earth-bound vehicles, including trains, motor vehicles and ships. One type of low-profile antenna is a marker-beacon antenna, such as described by R. A. Burberry, "VHF and UHF Antennas", Peter Peregnus, Ltd., UK, 1992, p. 161. Other types of low-profile antennas are described in U.S. Pat. No. 5,880,697 to McCarrick et al. and U.S. Pat. No. 4,862,181 to Ponce De Leon et al. Each of these different types of low-profile antennas includes an elongated radiator element configured and disposed in relation to a ground plane to define a vertical loop when the ground plane is horizontally disposed, with a substantial broad segment of the radiator element being parallel to the ground-plane element, with one end of the radiator element being connected to the ground-plane element and with another end of the radiator element being capacitively coupled to the ground-plane element.

SUMMARY OF THE INVENTION

The present invention provides a low-profile antenna of simple construction that may be operated within an adjustable range of frequencies.

An antenna according to the present invention comprises a ground-plane element defining a ground plane; an elongated radiator element configured and disposed in relation to the ground plane to define a vertical loop when the ground plane is horizontally disposed, with a substantial broad segment of the radiator element being parallel to the ground plane, with one end of the radiator element being connected to the ground-plane element and with another end of the radiator element being capacitively coupled to the ground-plane element; a dielectric spacing element disposed between the other end of the radiator element and the ground-plane element for capacitively coupling the radiator element to the ground-plane element; and a conductive-material layer contacting the other end of the radiator element between the other end of the radiator element and the dielectric spacing element with an exposed portion of the conductive-material layer extending from beneath the other end of the radiator element for enabling said capacitive coupling to be adjusted by removing at least some of the exposed portion of the conductive-material layer; wherein said adjustable capacitive coupling and the dimensions and configuration of the radiator element are such as to enable the radiator element to resonate within an adjustable band of frequencies within a predetermined range of frequencies. In the preferred embodiment, the exposed portion of the conductive-material layer includes a plurality of tabs that can be removed selectively to adjust said capacitive coupling.

In one aspect a low-profile antenna includes a tuning circuit that is coupled to the radiator element for selectively enabling the antenna to transmit signals at a first frequency within said band or to receive signals at a second frequency within said band.

Additional aspects and features of the present invention are described with reference to the detailed description of the preferred embodiments.

DETAILED DESCRIPTION

Figure 1:
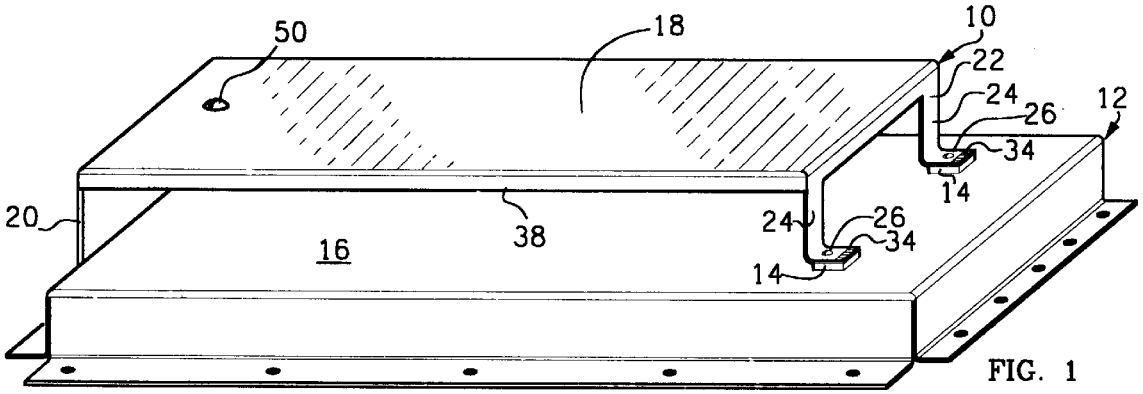
FIG. 1 is a perspective view of a preferred embodiment of a low-profile antenna according to the present invention.
Figure 2:
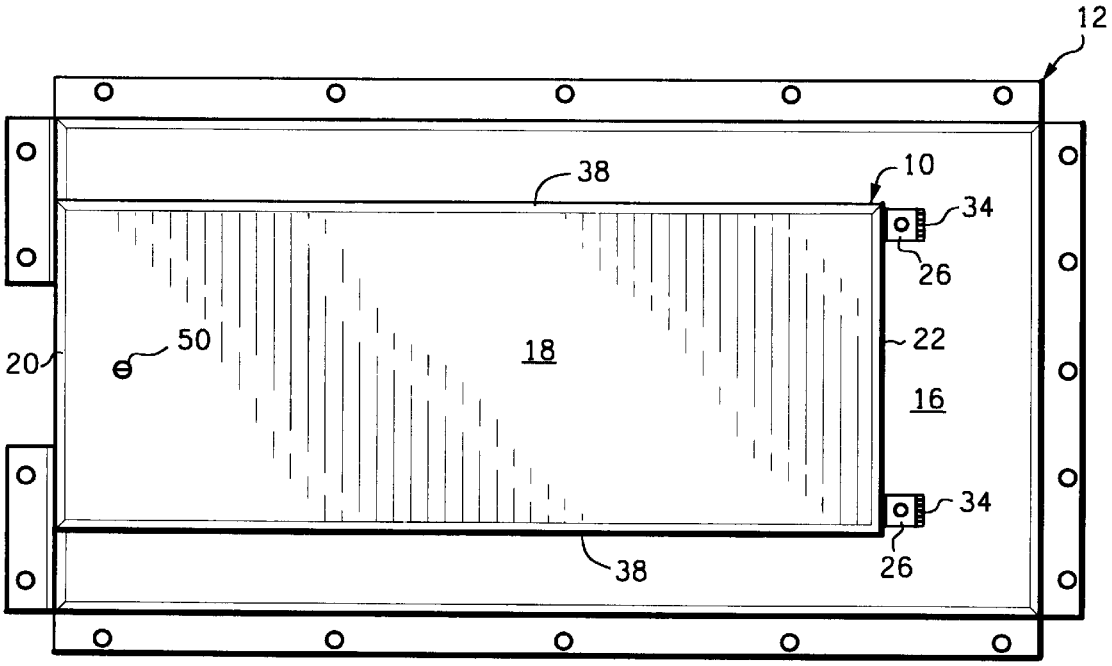
FIG. 2 is a top plan view of the antenna of FIG. 1.
Figure 3:
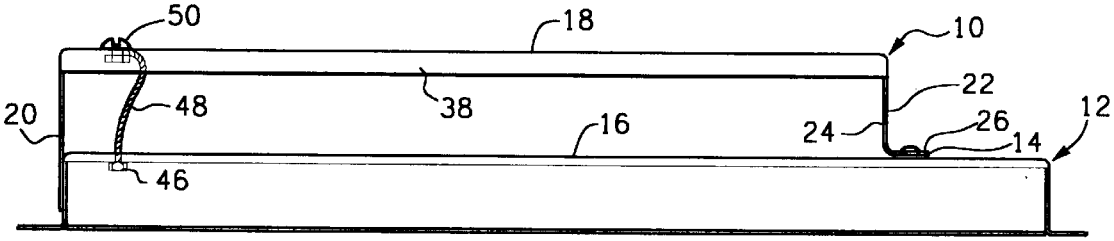
FIG. 3 is a plan view of the side of the antenna seen in FIG. 1.
Figure 4:
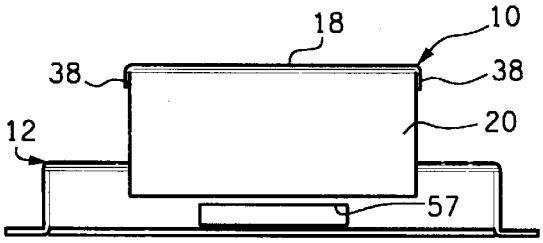
FIG. 4 is a plan view of one end of the antenna of FIG. 1.
Figure 5:
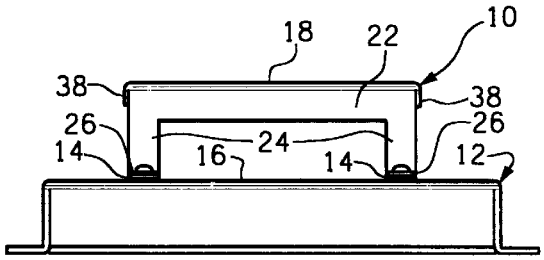
FIG. 5 is a right-side plan view of the other end of the antenna of FIG. 1.

Referring to FIGS. 1 through 5, a preferred embodiment of a low-profile antenna according to the present invention includes an elongated radiator element 10, a ground-plane element 12 and a pair of coupling pads 14.

The ground-plane element 12 includes a broad surface that defines a ground plane 16. The radiator element 10 is so configured and disposed in relation to the ground plane 16 as to define a vertical loop when the ground plane 16 is horizontally disposed. A substantial broad segment 18 of the radiator element 10 is parallel to the ground plane 16. One end 20 of the radiator element 10 is connected to the ground-plane element 12. The other end 22 of the radiator element 10 includes a pair of spaced-apart legs 24 respectively having feet 26 that are capacitively coupled to the ground-plane element 12 by the pair of coupling pads 14. The open area between the legs 24 enables more efficient radiation.

Figure 6:
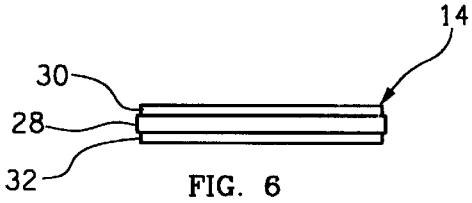
FIG. 6 is a sectional view of a coupling pad including a dielectric spacing element and a conductive-material layer that is respectively disposed between the ground-plane element and each of the feet of the legs of the radiator element in the antenna of FIG. 1.
Figure 7:
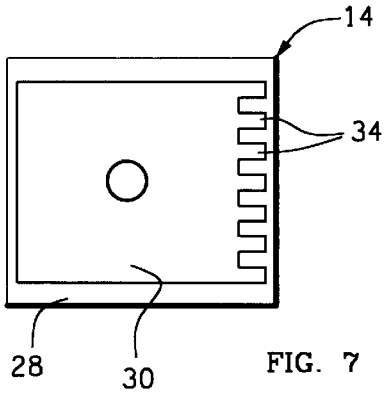
FIG. 7 is top plan view of the coupling pad of FIG. 6.

Referring to FIGS. 6 and 7, each coupling pad 14 includes a dielectric spacing element 28, a top conductive-material layer 30 and a bottom conductive-material layer 32. The coupling pads 14 underlie the feet 26 of the spaced-apart legs 24 and extend from beneath the feet 26. The bottom conductive-material layer 32 covers the bottom surface of dielectric spacing element 28 and contacts the ground-plane element 12. The dielectric spacing elements 28 are disposed between the feet 26 of the radiator element 10 and the ground-plane element 12 for capacitively coupling the radiator element 10 to the ground-plane element 12. The top conductive-material layer 30 includes a concealed portion that extends over that portion of the top surface of the dielectric spacing element 28 that directly underlies a respective foot 26 of the radiator element 10, and also includes an exposed portion that further extends over a portion of the top surface the dielectric spacing element 28 that extends from beneath the foot 26. The exposed portion of the top conductive-material layer 30 includes a plurality of tabs 34 that can be removed selectively to adjust the capacitive coupling between the radiator element 10 and the ground-plane element 12. The respective top conductive-material layers 30 of the coupling pads 14 thereby contact the feet 26 of the other end 22 of the radiator element 10 between the other end 22 of the radiator element 10 and the dielectric spacing elements 28 of the respective pads 14, with the exposed portions of the respective top conductive-material layers 30 extending from beneath the feet 26 of the radiator element 10 for enabling the capacitive coupling to be adjusted by removing at least some of the exposed tabs 34 of the top conductive-material layers 30.

Such adjustable capacitive coupling and the dimensions and configuration of the radiator element are such as to enable the radiator element to resonate within an adjustable band of frequencies within a predetermined range of frequencies. The bandwidth is primarily determined by the height of the broad segment 18 of the radiator element 10 above the ground plane element 12 and by the amount of capacitive coupling between the other end 22 of the radiator element 10 and the ground plane element 12. The bandwidth is proportional to such height and is inversely proportional to such capacitance. The width W of the broad segment 18 has a slight impact on the bandwidth. The bandwidth increases slightly when the width W is increased.

The center resonant frequency of the antenna is primarily determined by the length of the broad segment 18 of the radiator element 10 between the one end 20 and the other end 22 and by the capacitive coupling between the other end 22 and the ground plane element 12. The center resonant frequency is inversely proportional to the length of the radiator element 10 and inversely proportional to the capacitance between the other end 22 and the ground plane element 12. The width of the broad segment 18 of the radiator element 10 and the height of the broad segment 18 above the ground plane element 12 have a slight impact on the center resonant frequency. The center resonant frequency decreases slightly when the width and/or the height is increased.

The length of the broad segment 18 must be less than a quarter of a wavelength corresponding to the center resonant frequency. The width W of the broad segment 18 must be less than half of such wavelength. The height of the broad segment 18 of the radiator element 10 above the ground plane element 12 is typically much less than a quarter of such wavelength. The opening between the legs 24 preferably is as large as possible to maximize the antenna radiation efficiency while maintaining a minimum mechanical strength. All of these dimensions can be changed to a certain extent and still achieve the desired frequencies and bandwidth. The dimensions are selected to make the antenna as small as possible while maintaining a minimum bandwidth.

Referring again to FIGS. 1–5, the radiator element 10 includes longitudinal folds 38 distending from the sides of the substantial broad segment 18 toward, but not extending to, the ground-plane element 12. The substantial broad segment 18, the end portions 20, 22 and the longitudinal folds 38 of the radiator element 10 are embodied in a continuous metal sheet. Such construction provides a radiator element 10 that is quite sturdy and not subject to variations in performance due to significant fluctuations in shape resulting from mechanical vibration.

Figure 8:
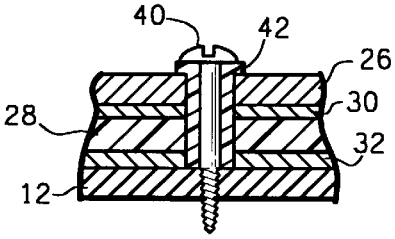
FIG. 8 is a partial sectional view illustrating the attachment of the other end of the radiator element to the ground-plane element.

Referring to FIG. 8, the construction of the antenna is made even more sturdy by using metal screws 40 to fasten the feet 26 of the spaced apart legs 24 to the ground-plane element 12. Sheaths of insulating material, such as shoulder washers 42, are disposed for insulating the feet 26 of the radiator element 10 from the metal screws 40. The metal screws 40 are electrically connected to the ground plane element 12. The shoulder washers 42 are made of a hard, non-conductive material, such as FR4 (fiberglass epoxy), that has low absorption of radio-frequency energy (low loss tangent). The shoulder washers 42 affect the coupling capacitance between the radiator element 10 and the ground-plane element 12 only slightly in comparison to the capacitive-coupling effect of the coupling pads 14.

The antenna also includes a feed element 46 in the form of a coaxial bulkhead connector that extends through a wall of the ground plane element 12, and a braided wire 48 connecting the feed element 46 to the broad segment 18 of the radiator element 10. The braided wire 48 further enhances the sturdy construction and reliable performance of the antenna because the braided wire 48 can flex and thereby is less likely to break due to vibration. The braided wire 48 is connected to the underside of the broad segment 18 of the radiator element 10 with a metal screw 50 at a location that is midway between the sides of the broad segment 18 and is closer to the one end 20 than to the other end 22, with said location being such as to cause the antenna to have a predetermined nominal impedance (typically close to 50 ohms) within a desired bandwidth about the resonant frequency at which signals are transmitted by the antenna.

Figure 9:
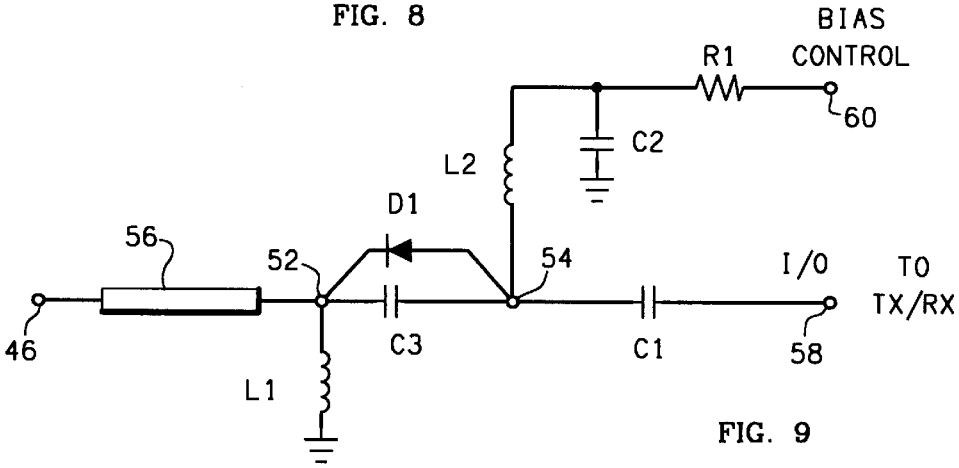
FIG. 9 is a schematic circuit diagram of a tuning circuit for the antenna of FIG. 1.

The antenna includes a tuning circuit that is coupled to the radiator element 10 for selectively enabling the antenna to transmit signals at a first frequency within the adjustable band of frequencies within the predetermined range of frequencies or to receive signals at a second frequency within said band. Referring to FIG. 9, a preferred embodiment of the tuning circuit includes an RF diode switch D1, a first RF shorting capacitor C1, a second RF shorting capacitor C2, a tuning capacitor C3, a first RF open inductor L1, a second RF open inductor L2, and a current limiting resistor R1. The RF diode switch D1 and the tuning capacitor C3 are connected in parallel between a first terminal 52 and a second terminal 54. A transmission line 56 connects the first terminal 52 to the feed element 46. The first RF open inductor L1 is connected between the first terminal 52 and circuit ground. The first shorting capacitor C1 is connected between the second terminal 54 and an input/output (I/O) terminal 58, to which an RF transceiver may be connected, to thereby connect the tuning capacitor C3 in series between the feed element 46 and the I/O terminal 58. The second RF open inductor L2 is connected between the second terminal 54 and the current limiting resistor R1, the other side of which is connected to a control terminal 60, to which a DC bias voltage can be applied to control the operation of the RF diode switch D1. The second shorting capacitor C2 is connected between circuit ground and the junction of the second RF open inductor L2 and the current limiting resistor R1.

The transmission line 56 has a characteristic impedance that is approximately the same as the nominal impedance of the antenna. The length of the transmission line 56 is selected such that the transmission line 56 transforms the antenna impedance such that within a desired receive frequency band the resistive portion of the antenna impedance is near the nominal resistance of the antenna. The tuning capacitor C3 is selected to be of such a value as to cancel the reactive portion of the antenna impedance and shift the resonant frequency at the I/O terminal 58 from the transmit frequency band to the receive frequency band. When the RF diode switch D1 is turned on, the tuning capacitor C3 is bypassed. Thus, the tuning circuit of FIG. 9 enables the antenna to transmit signals at a first frequency when the RF diode switch is turned on, and to receive signals at a second frequency at the I/O terminal 58 when the RF diode switch D1 is turned off. The I/O terminal 58 is isolated from the control terminal 60 by the combination of the first RF shorting capacitor C1, the second RF shorting capacitor C2 and the second RF open inductor L2. The first RF shorting capacitor C1 and the second RF shorting capacitor C2 are of the same value; and the first RF open inductor L1 and the second RF open inductor L2 are of the same value.

In a preferred embodiment the tuning circuit is contained within a housing defined by the ground plane element 12, with the I/O terminal 58 and the control terminal 60 being disposed at an aperture 57 in the ground plane element 12.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

We claim:

1. An antenna, comprising a ground-plane element defining a ground plane;

an elongated radiator element configured and disposed in relation to the ground plane to define a vertical loop when the ground plane is horizontally disposed, with a substantial broad segment of the radiator element being parallel to the ground plane, with one end of the radiator element being connected to the ground-plane element and with another end of the radiator element being capacitively coupled to the ground-plane element;

a dielectric spacing element disposed between the other end of the radiator element and the ground-plane element for capacitively coupling the radiator element to the ground-plane element; and a conductive-material layer contacting the other end of the radiator element between the other end of the radiator element and the dielectric spacing element with an exposed portion of the conductive-material layer extending from beneath the other end of the radiator element for enabling said capacitive coupling to be adjusted by removing at least some of the exposed portion of the conductive-material layer;

wherein said adjustable capacitive coupling and the dimensions and configuration of the radiator element are such as to enable the radiator element to resonate within an adjustable band of frequencies within a predetermined range of frequencies.

2. An antenna according to claim 1, wherein the exposed portion of the conductive-material layer includes a plurality of tabs that can be removed selectively to adjust said capacitive coupling.

3. An antenna according to claim 1, wherein the other end of the radiator element includes spaced-apart legs respectively having feet that are coupled to the ground-plane element by the dielectric spacing element.

4. An antenna according to claim 3, wherein the dielectric spacing element includes portions respectively disposed between the feet of the spaced-apart legs and the ground-plane element and the conductive-material layer includes portions respectively contacting the feet of the spaced-apart legs and having exposed portions extending from beneath the feet of the spaced-apart legs.

5. An antenna according to claim 4, wherein the exposed portions of the conductive-material layer include a plurality of tabs that can be removed selectively to adjust said capacitive coupling.

6. An antenna according to claim 3, wherein the legs consist of a pair of legs disposed at opposite sides of the other end of the radiator element.

7. An antenna according to claim 1, wherein the radiator element includes longitudinal folds distending from the sides of the substantial broad segment toward, but not extending to, the ground-plane element.

8. An antenna according to claim 7, wherein the substantial broad segment, the end portions and the longitudinal folds of the radiator element are embodied in a continuous metal sheet.

9. An antenna according to claim 1, further comprising a feed element and a braided wire connecting the radiator element to the feed element.

10. An antenna according to claim 1, further comprising a tuning circuit that is coupled to the radiator element for selectively enabling the antenna to transmit signals at a first frequency within said band or to receive signals at a second frequency within said band.

11. An antenna, comprising a feed element;

a ground-plane element defining a ground plane;

an elongated radiator element coupled to the feed element and configured and disposed in relation to the ground plane to define a vertical loop when the ground plane is horizontally disposed, with a substantial broad segment of the radiator element being parallel to the ground plane, with one end of the radiator element being connected to the ground-plane element and with another end of the radiator element being capacitively coupled to the ground-plane element; and a dielectric spacing element disposed between the other end of the radiator element and the ground-plane element for capacitively coupling the radiator element to the ground-plane element, wherein said capacitive coupling and the dimensions and configuration of the radiator element are such as to enable the radiator element to resonate within a band of frequencies determined by said capacitive coupling within a predetermined range of frequencies primarily determined by said dimensions and configuration; and a tuning circuit coupled to the radiator element for selectively enabling the antenna to transmit signals at a first frequency within said band or to receive signals at a second frequency within said band.

12. An antenna according to claim 11, wherein the tuning circuit comprises a transmission line coupled to the radiator element and having a characteristic impedance that is approximately the same as a nominal impedance of the antenna and being of such length as to transform the antenna impedance such that within a desired frequency band the resistive portion of the antenna impedance is near the nominal resistance of the antenna;

a tuning capacitor connected between the transmission line and an input/output (I/O) terminal and being of such a value as to cancel the reactive portion of the antenna impedance and shift the resonant frequency at the I/O terminal; and a switch connected in parallel with the tuning capacitor for bypassing the tuning capacitor when the switch is turned on to thereby enable the antenna to transmit signals at the first frequency when the switch is turned on, and to receive signals at the second frequency at the I/O terminal when the switch is turned off.

13. An antenna according to claim 11, wherein the tuning circuit is contained within a housing defined by the ground plane element.

14. An antenna, comprising a ground-plane element defining a ground plane;

an elongated radiator element configured and disposed in relation to the ground plane to define a vertical loop when the ground plane is horizontally disposed, with a substantial broad segment of the radiator element being parallel to the ground plane, with one end of the radiator element being connected to the ground-plane element and with another end of the radiator element being capacitively coupled to the ground-plane element; and a dielectric spacing element disposed between the other end of the radiator element and the ground-plane element for capacitively coupling the radiator element to the ground-plane element;

wherein the other end of the radiator element is configured to include spaced-apart legs respectively having feet that are coupled to the ground-plane element by portions of the dielectric spacing element;

wherein said capacitive coupling and the dimensions and configurations of the radiator element are such as to enable the radiator element to resonate within a given band of frequencies.

15. An antenna according to claim 14, wherein the radiator element includes longitudinal folds distending from the sides of the substantial broad segment toward, but not extending to, the ground-plane element.

16. An antenna according to claim 15, wherein the substantial broad segment, the end portions and the longitudinal folds of the radiator element are embodied in a continuous metal sheet.

17. An antenna according to claim 14, further comprising metal screws fastening the feet of the spaced apart legs to the ground-plane element; and sheaths of insulating material disposed for insulating the radiator element from the metal screws.

18. An antenna according to claim 14, further comprising a feed element and a braided wire connecting the radiator element to the feed element.

19. An antenna, comprising a ground-plane element defining a ground plane;

an elongated radiator element configured and disposed in relation to the ground plane to define a vertical loop when the ground plane is horizontally disposed, with a substantial broad segment of the radiator element being parallel to the ground plane, with one end of the radiator element being connected to the ground-plane element and with another end of the radiator element being capacitively coupled to the ground-plane element; and a dielectric spacing element disposed between the other end of the radiator element and the ground-plane element for capacitively coupling the radiator element to the ground-plane element;

wherein the radiator element includes longitudinal folds distending from the sides of the substantial broad segment toward, but not extending to, the ground-plane element.

20. An antenna according to claim 19, wherein the substantial broad segment, the end portions and the longitudinal folds of the radiator element are embodied in a continuous metal sheet.

21. An antenna according to claim 19, further comprising metal screws fastening the feet of the spaced apart legs to the ground-plane element; and sheaths of insulating material disposed for insulating the radiator element from the metal screws.

22. An antenna according to claim 19, further comprising a feed element and a braided wire connecting the radiator element to the feed element.

23. An antenna, comprising a feed element;

a ground-plane element defining a ground plane;

an elongated radiator element connected to the feed element configured and disposed in relation to the ground plane to define a vertical loop when the ground plane is horizontally disposed, with a substantial broad segment of the radiator element being parallel to the ground plane, with one end of the radiator element being connected to the ground-plane element and with another end of the radiator element being capacitively coupled to the ground-plane element;

a dielectric spacing element disposed between the other end of the radiator element and the ground-plane element for capacitively coupling the radiator element to the ground-plane element; and a braided wire connecting the radiator element to the feed element.

* * * * *